US009388676B2

(12) United States Patent
Jorshari

(10) Patent No.: US 9,388,676 B2
(45) Date of Patent: Jul. 12, 2016

(54) SAGD OIL RECOVERY METHOD UTILIZING MULTI-LATERAL PRODUCTION WELLS AND/OR COMMON FLOW DIRECTION

(71) Applicant: Husky Oil Operations Limited, Calgary (CA)

(72) Inventor: Kamran R. Jorshari, Calgary (CA)

(73) Assignee: Husky Oil Operations Limited, Calgary (CA)

( * ) Notice: Subject to any disclaimer, the term of this patent is extended or adjusted under 35 U.S.C. 154(b) by 263 days.

(21) Appl. No.: 13/667,854

(22) Filed: Nov. 2, 2012

(65) Prior Publication Data

US 2014/0124194 A1 May 8, 2014

(51) Int. Cl.

| | |
|---|---|
| ***E21B 43/24*** | (2006.01) |
| ***E21B 7/04*** | (2006.01) |
| ***E21B 43/30*** | (2006.01) |

(52) U.S. Cl.

CPC ..... *E21B 43/24* (2013.01); *E21B 7/046* (2013.01); *E21B 43/2406* (2013.01); *E21B 43/305* (2013.01)

(58) Field of Classification Search

CPC ..... E21B 43/2406

USPC ..... 166/313, 245, 303, 305.1, 272.3

See application file for complete search history.

(56) References Cited

U.S. PATENT DOCUMENTS

| | | | | |
|---|---|---|---|---|
| 2009/0126929 | A1* | 5/2009 | Vinegar | 166/263 |
| 2010/0012331 | A1* | 1/2010 | Larter | C09K 8/58 166/401 |
| 2011/0247807 | A1* | 10/2011 | Harris et al. | 166/272.1 |

* cited by examiner

*Primary Examiner* — Brad Harcourt
(74) *Attorney, Agent, or Firm* — Frost Brown Todd LLC

(57) ABSTRACT

Improved SAGD methods for recovering heavy oil from underground formations. In a first aspect a method is provided for drilling, using multi-lateral drilling techniques, a series of horizontal collector wells from a vertical shaft of a production well, below and parallel to an injection well. In a further alternative to the typical SAGD configuration having injector and producer well drilled from the same end of a region under development, the production well is instead drilled at an end of a region of development opposite to an end of such region at which an injector well is drilled. Lastly, in yet another aspect, the invention comprises a method for rejuvenating an existing SAGD well pair, comprising drilling a further production well or wells at an opposite end of said formation at which an existing injector well was drilled, preferably using multi-lateral drilling techniques.

8 Claims, 13 Drawing Sheets

SAGD OIL RECOVERY METHOD UTILIZING MULTI-LATERAL PRODUCTION WELLS AND/OR COMMON FLOW DIRECTION

FIELD INVENTION

The present invention relates to a bitumen or heavy oil extraction process, and more particularly to improved SAGD oil recovery methods for producing oil or bitumen from subterranean hydrocarbon deposits using injection of a flowable medium comprising a heated fluid or a viscosity-reducing agent.

BACKGROUND OF THE INVENTION

In a SAGD (Steam Assisted Gravity Drainage) method for recovering bitumen or viscous oil from a hydrocarbon-containing formation, a horizontal injector well is drilled relatively high in a region of the formation under development. A parallel horizontal production well is drilled low in the region of the formation under development. The production well has a horizontal portion typically situated 5-6 meters directly below the horizontal portion of the injector well, and parallel thereto, and which like the horizontal portion of the injector well, extends into the hydrocarbon-containing layer. Steam is injected into the hydrocarbon formation via the horizontal portion of the injector well, and oil within the formation which becomes heated and thereafter becomes mobile, by force of gravity and/or pressure drains downwardly in the formation where it is collected in the horizontal portion of the production well and produced to surface.

Typically, the injector well and the collector well of a SAGD well pair are drilled from one end of a development region within the formation, and typically from the same well pad at one end of such development region.

Where a large formation is being exploited, numerous SAGD well pairs comprising parallel, vertically aligned injector and producer wells are aligned in side-by side juxtaposed position, with each producer well being positioned vertically below a paired injector well.

Large capital costs are incurred in not only drilling the injector and producer wells, but also in obtaining the necessary equipment, such as steam generating equipment and piping, for such SAGD method of recovery.

Clearly, therefore, in light of these large capital costs, it is advantageous to maximize oil production from such wells to ensure the greatest return on investment, and further recover such oil as quickly as possible once these capital costs have been incurred to thereby obtain the quickest return on investment.

Accordingly, a real need exists to improve upon the existing SAGD method to realize these objectives.

In addition, problems may arise in existing SAGD well pairs during the life of such wells, such as "sanding in" of production wells, or leakage of steam from the injector wells directly into the production well without flowing firstly through the desired areas in the development regions which are desired to be heated to mobilize oil therein. Both of these problems significantly reduce the volume and recovery rates of oil from such wells and/or may possibly prevent further recovery of economic amounts of oil even though a significant amount of heavy oil may still remain in the region of the formation under development.

Accordingly, a real need further exists for an effective manner of recuperating or rejuvenating production wells in SAGD well pairs which are not operating to maximum potential, in order to recover as much of the oil from the region under development and avoid loss of invested capital.

SUMMARY OF THE INVENTION

The present invention comprises modifications to the standard SAGD method for recovery of oil from a formation, wherein such method is modified in configuration and/or in manner of drilling to result in lower capital cost (for same number of drilled wells), or increased rate of production, or both.

Specifically, in a first embodiment of the present invention, it has been experimentally and surprisingly found that if the ratio of the number of collector wells to injector wells in the above standard SAGD configuration of wells is increased, for the same number of wells as would be drilled for the standard SAGD configuration and under typical conditions as exist in heavy oil formations, an increase in both the rate of production of oil and the cumulative oil produced can be obtained over the figures that would otherwise be obtained from the conventional SAGD configuration.

As a result of such aforementioned discovery confirming the desirability for drilling proportionately more collector wells in relation to injector wells, the present invention, in an alternative or additional aspect, provides for a modified SAGD method comprising the drilling of a plurality of horizontal collector (production) wells from a common shaft using multi-lateral well drilling techniques, to be paired with a single injector well. In such manner the benefit of increased number of horizontal collector wells in relation to injector wells can be realized, but at a fraction of the cost of drilling separately such additional number of horizontal collector wells by being able to economize in using as common to all such wells the vertical or inclined portion of the production well.

In addition, in a further alternative or additional modification to the standard SAGD configuration of injector/producer well pairs wherein the injector well and production well are each drilled from a common end of a region of a formation under development, the present invention comprises a modification of such method to reduce leakage of steam from the injector well into the production well and improve the rate and amount of oil produced. Specifically, the present invention, in an alternative embodiment, comprises the modification to the convention SAGD oil recovery process by instead drilling the production well from an end of a region the formation under development opposite that end at which the injector well has been drilled. In such manner, undesirable leakage of steam from the injection well into the production (collector) well(s) can be reduced resulting in an increase in rates and amounts of oil produced.

The above separate modifications to the standard SAGD methodology can be employed separately, or in combination.

In a further alternative embodiment, the present invention provides for a method of improving/rejuvenating the performance of a standard SAGD well pair. Specifically, an existing SAGD well pair can have its production of oil increased, particularly in instances where the horizontal portion of the production well has become "sanded in" and/or there is extensive leakage of steam from the injector well into the collector well which has resulted in reduced or no production from the collector well, by the drilling of one or more additional collector (production) wells, wherein said collector well(s) is/are drilled from an opposite end of the region of the formation under development than the end which the original injector and collector well were drilled. This result has further been experimentally confirmed by in-field testing, specifically as identified in SPE publication CSUG/SPE SPE-149239-PP entitled "*A New SAGD Well Pair Placement; a Field Case Review*" presented at the Canadian Unconventional Resources Conference held in Calgary, Alberta, Canada, 15-17 Nov. 2011. Specifically, by using this method of rejuvenating the standard SAGD well pair, the rate of oil produced from the new collector well which is drilled from an opposite end of the region of the formation under development has been found to produce increased rates and amounts of oil production as compared to the rates and amounts of oil production in comparison with output obtained from the original previously-drilled collector well. It is suspected and theorized, without being limited to such theory, that by providing the production well at an opposite end of the region of development that the steam injector well, the direction of flow of the steam in the injector well and the oil in the production (collector) wells are made the same, thereby aligning high pressure regions in each of the production well and injector well (and likewise thereby aligning low pressure regions in each of the production well and injector well) and leakage of steam via "fingering" in the formation from the heel end of the injector well into the production well is avoided or at least reduced. Such method of rejuvenation of existing standard SAGD well pairs may be further modified to take advantage of the above discovery of using increased ratio of production wells to injector wells, and the lower capital cost of drilling such wells using multi-lateral drilling techniques, if a plurality of collector wells are drilled and/or if a plurality of production (collector) wells are drilled from an opposite end of a region of the formation under development than the original injector well was drilled. Due to the elimination or reduction of "leakage", improved CSOR (cumulative steam-oil recovered ration) will also be realized.

Accordingly, a first object of the present invention is to provide for increased production and rates of production in SAGD applications A second object of the present invention is to reduce capital costs, as compared to standard SAGD methods.

A third object of the invention is to provide an improved SAGD method of oil recovery where instances of undesirable leakage (ie "short-circuiting") of steam directly from injector well to the producer well are reduced or avoided, to thereby improve the overall performance (cumulative oil, and rate of production) of a SAGD well pair, and reduce the CSOR (cumulative steam-oil recovered ratio).

A still further alternative object of the invention is to provide for a manner of rejuvenating SAGD well pairs to avoid loss of capital when recovery rates from the producer well have dropped below economic recovery rates, but where significant quantities of oil still remain in the region of the formation under development.

The above are non-limiting objects of the present invention, and may be used in combination, or separately.

The above objects to are not to be construed as necessarily representing, jointly or severally, objects attained by each and every aspect of the present invention.

To realize one or more of the above objects, in a first broad aspect of the present invention, the present invention comprises modifying the production well-drilling step of a standard SAGD method of recovery to comprise drilling a plurality of multi-lateral horizontal collector wells parallel to the injector well, and extending horizontally outwardly from the vertical well portion of the production well, but with each horizontal collector well positioned immediately below such injector well. In a preferred embodiment one of the multi-lateral collector wells is positioned immediately vertically below the horizontal portion of the steam injector well.

Specifically, in such first broad aspect of the present invention, such invention comprises an improved method for recovering oil or bitumen from a development region of a hydrocarbon-containing subterranean formation, comprising the steps of:

(i) drilling an injection well having a vertical or inclined portion and further having a substantially horizontal portion extending into said development region adapted for injecting a medium comprising a heated fluid or viscosity-reducing agent into said development region;

(ii) drilling a production well having a common downwardly extending inclined or vertical shaft portion, and, using multi-lateral well-drilling techniques, drilling a plurality of substantially parallel horizontal collector wells extending outwardly therefrom into said development region, each of said parallel horizontal collector wells extending substantially parallel and proximate to said horizontal portion of said injection well but spaced vertically below said horizontal portion of said injection well;

(iii) injecting a medium comprising a heated fluid such as steam or a viscosity-reducing agent into said injection well and thereby into the development region via said horizontal portion thereof; and (vi) collecting, via said plurality of horizontal collector wells, oil from said development region that has flowed into said collector wells, and producing said oil to surface.

The plurality of horizontal collector wells are positioned vertically below the injector well, and parallel thereto and to each other, but may be at the same or different individual depths below the injector well.

The term "heated fluid" is herein defined and intended to comprise any flowable medium which may be heated, such as steam, heated water, or the like, which can transfer heat into a region of development of a formation containing oil, and by transferring such heat to oil or bitumen in the formation, reduce the viscosity of such oil and/or cause such oil to become mobile and, via existing pressure in the formation and/or gravity, be caused to flow downwardly.

The term "viscosity-reducing agent" is herein defined and intended to comprise a flowable medium which reduces the viscosity of oil or bitumen in the formation so as to cause such oil or bitumen to become mobile. Numerous viscosity-reducing agents for reducing the viscosity of oil and bitumen in a formation are well known to persons of skill in the art, and include, but are not limited to, flowable mediums such as naptha, diesel, carbon dioxide gas, non-condensable gases such as methane or ethane, or mixtures thereof.

In a preferred embodiment of the above method, the plurality of collector wells comprises three parallel collector wells, comprising a first horizontal collector well drilled immediately below said horizontal portion of said injection well and parallel thereto, and two horizontal production wells drilled respectively on each side of the first collector well, in mutually parallel relation, but laterally spaced therefrom.

In a further embodiment, the vertical or inclined portion of the injection well, and the inclined or vertical shaft of the production well, are one and the same. This allows for further economy in drilling of the wells in that only one vertical or inclined shaft need to be drilled, and by using multi-lateral drilling techniques, as further discussed herein, the horizontal injector well and horizontal collector wells may be drilled laterally outwardly from such inclined or vertical portion.

In a further refinement of the above method, said vertical or inclined portion of said injection well is drilled at one end of said development region, and said inclined or vertical shaft of said production well is situated at a mutually opposite end of said development region, so that the medium enters said development region at one end thereof and flows in a first direction along said horizontal injection well to reduce viscosity of oil in the development region, and said common inclined or vertical shaft of said production well is drilled at an opposite end of said development region so that oil which collects in said horizontal collector wells flows within said horizontal collector wells in the same direction as said first direction, namely in the same direction as steam in said injector well.

In a further alternative broad aspect of the present invention, the present invention comprises an improved oil recovery method for recovering oil from a development region of a hydrocarbon-containing subterranean formation, comprising the steps of:

(i) drilling, at one end of said development region, an injection well, having a vertical or inclined portion, and further having a horizontal portion extending into said development region and adapted for injecting a medium comprising a heated fluid or viscosity-reducing agent into said development region;

(ii) drilling, via a common inclined or vertical shaft, at a mutually opposite end of said development region, at least one production well having at least one horizontal collector portion substantially parallel and proximate to said horizontal portion of said injection well but spaced vertically below said horizontal portion of said injection well and extending into said development region;

(iii) injecting a flowable compressible medium comprising a heated fluid or a viscosity-reducing agent into said injection well and into the development region via said horizontal portion of said injection well; and (vi) collecting within said at least one horizontal collector portion oil within said formation that has flowed into said collector portion, and producing such oil to surface;

wherein said medium enters said development region at one end thereof via said injector well and flows in a first direction along said horizontal portion of said injection well; and wherein oil which collects in said at least one horizontal collector portion of said production well flows within said horizontal portion in a direction the same as said medium in said injection well.

The medium used in this embodiment is typically a compressible fluid, since the problem with leakage typically arises due to non-uniform pressure along the injector well which is exacerbated when compressible fluids are used. Drilling the production well at an end of the region of development opposite that end which the injector well is drilled is adapted to overcome or alleviate such problem, and thus this aspect of the invention will most suitably be adapted for applications where a compressible fluid, such as steam, is used.

In a preferred embodiment of the above further aspect of the invention, wherein step (ii) comprising drilling at least one production well at an opposite end of the development region having at least one horizontal collector portion comprises drilling, using multi-lateral drilling techniques, a plurality of horizontal collector wells extending outwardly from said vertical or inclined shaft portion, each of said plurality of collector wells having a horizontal portions substantially parallel and proximate to said injection well, but spaced vertically below said horizontal portion of said injection well; and collecting within said horizontal portion of each of said collector wells oil from said formation that has flowed into said further collector wells, and producing said oil to surface via said common inclined or vertical shaft.

In a further embodiment, three (3) collector wells are drilled—a first collector well directly below and parallel to said injector well, and the second and third collector wells positioned on each side of said first collector well, in mutually parallel relation, but laterally spaced therefrom.

In a still further separate aspect of the present invention, the invention comprises a method for improving recovery from a hydrocarbon-containing formation having an already-drilled and existing well pair comprising an injector well and a production well, said injector well having a horizontal portion extending into a region of the formation under development, said production well having vertical or inclined shaft portion and a horizontal portion substantially extending outwardly therefrom and parallel to said horizontal portion of said injector well but spaced vertically below said horizontal portion of said injector well, wherein said injector well and production well are drilled from a same first end of a region of the formation under development, comprising the steps of:

(i) drilling, using multi-lateral well drilling techniques, from said vertical or inclined shaft portion of said production well, at least one further horizontal well, hereinafter referred to as a collector well, extending outwardly therefrom and parallel to said horizontal portion of said injector well, said collector well spaced vertically below said horizontal portion of said injector well.

In an alternative embodiment for improving recovery from a hydrocarbon-containing formation, namely for improving recovery from a hydrocarbon-containing formation having an already-drilled SAGD well pair comprising an steam injector well and a production well, said injector well having a horizontal portion extending into a region of the formation under development, said collector well having a horizontal portion substantially parallel to said horizontal portion of said injector well but spaced vertically below said horizontal portion of said injector well, wherein said injector well and collector well are drilled from a same first end of a region of the formation under development, such invention comprises the steps of:

(i) drilling, at a second opposite end of said region of the formation under development proximate a toe portion of said injector well, and via a common inclined or vertical shaft, at least one further production well having a horizontal portion substantially parallel to said injector well but spaced vertically below said horizontal portion of said injector well and extending into the development region;

(ii) injecting a medium such as a heated fluid or viscosity-reducing agent into said injector well and thereby into the region of the formation under development via said horizontal portion of said injector well; and (iii) collecting within said horizontal portion of said at least one further production well, oil from said formation that has flowed into said further production well, and producing said oil to surface.

In a preferred embodiment of such still further aspect, —said above step (i) of such still further aspect of the present invention comprises:

drilling a plurality of production wells said at least one further collector wells, each of said plurality of production wells having a horizontal portion substantially parallel and proximate to said injector well, but spaced vertically below said horizontal portion of said injector well; and—collecting within said horizontal portion of each of said plurality of production wells heated oil from said formation that has flowed into said further collector wells; and producing said oil to surface via said common inclined or vertical shaft.

In an alternative preferred embodiment of the embodiment for improving recovery from an already-drilled SAGD well pair, such comprises:

drilling, at said second opposite end of the region under development and using multi-lateral drilling techniques, a production well having a common inclined or vertical shaft and a plurality of horizontal portions extending outwardly therefrom in the form of parallel collector wells substantially parallel to said injector well but spaced vertically below said horizontal portion of said injector well and extending into the development region; and collecting within said horizontal portion of each of said collector wells, oil from said formation that has flowed into said further collector wells, and producing said oil to surface via said common inclined or vertical shaft.

BRIEF DESCRIPTION OF THE DRAWINGS

In the accompanying drawings, which illustrate one or more exemplary embodiments and are not to be construed as limiting the invention to these depicted embodiments.

DETAILED DESCRIPTION OF THE PRIOR ART AND PREFERRED EMBODIMENTS OF THE PRESENT INVENTION

First Embodiment

Figure 1:
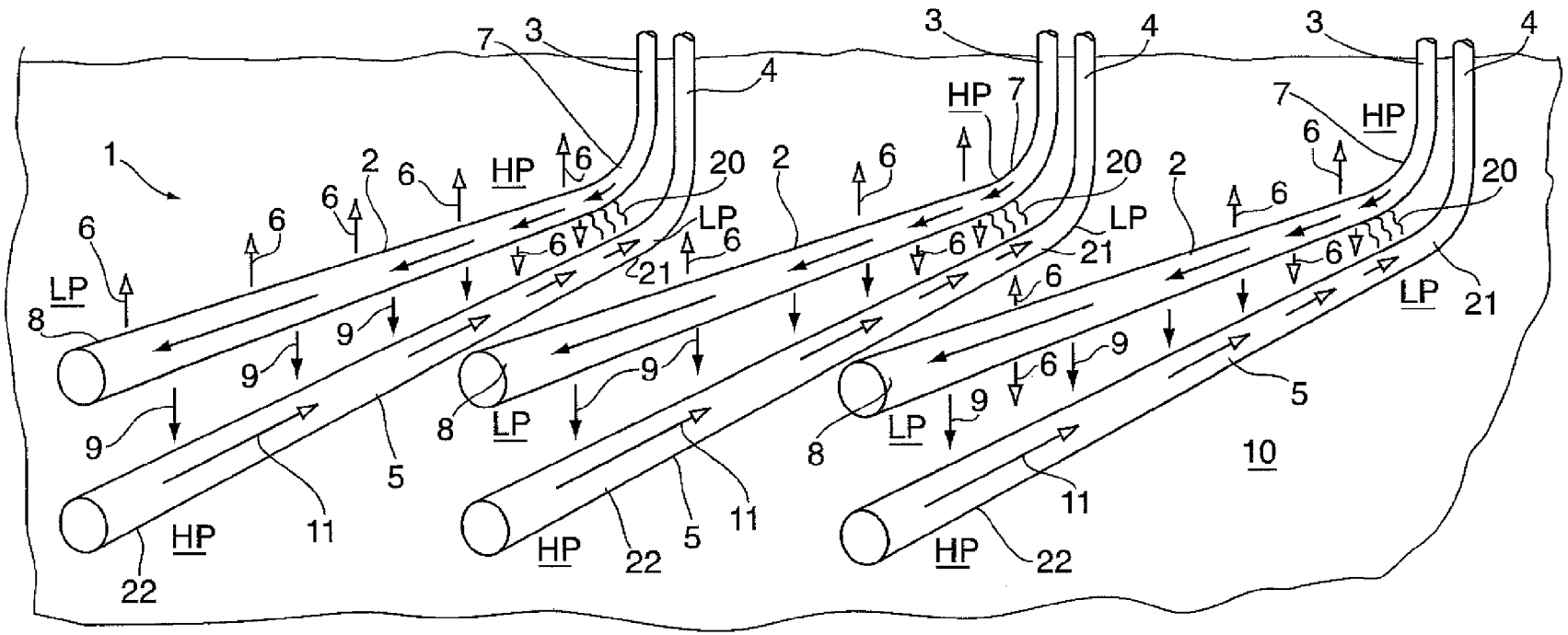
Fig. 1 ( Prior Art )
FIG. 1 is a perspective view of a steam assisted gravity drainage configuration of the prior art, comprising a series of mutually parallel, paired injector and collector wells.

FIG. 1 shows a perspective view of a steam assisted gravity drainage configuration 1 of the prior art, comprising a series of steam injector wells 3 having perforations therein (not shown) for injecting steam 6 into a development region 10 of an underground hydrocarbon-containing formation. Injector wells 3 possess respectively parallel horizontal portions 2 extending into a development region 10 of the formation. A corresponding number of production wells 4 are provided with substantially horizontal portions 5 thereof positioned directly vertically below respective horizontal portions 2 of the steam injector wells 3, but parallel to the horizontal portions 2 of the steam injector wells 3.

Heated oil 9 within the development region 10 of the formation which has become heated drains downwardly in direction of arrows 9 and flows into horizontal portion 2 of the production wells 4 via perforated screens therein (not shown), where such oil 9 thereafter flows in direction 11 when being drawn along production well 4 and being produced to surface.

Horizontal portions 2 of steam injector wells 3 contain steam 6 at a high pressure HP proximate the heel 7 of the injector wells 3, but at a lower pressure LP proximate each of the toe regions 8 of the injector wells 3. Conversely, oil 9 in horizontal portions of production wells 4 is typically at its lowest pressure LP proximate heel region 21 of the production wells 4 while at its highest pressure HP proximate toe region 22 of each of production well 4, as shown in FIG. 1.

Disadvantageously with this prior art configuration of SAGD injector wells 4 and producer wells 3 shown in FIG. 1, due to the highest pressure of the steam 6 in injector well 3 being at the heel 7 thereof and the lowest pressure in the horizontal portion 5 of the production well 4 being likewise at the heel 21 thereof, there is a very strong tendency (and it is an all-to-common occurrence) for high pressure steam 6 at the heel 7 of the injector wells 3 to "short circuit" and, via finger-like fissures 20 in the development region 10, undesirably flow directly into the heel region 21 of the production well 4, thereby failing to be injected into the development region 10 along the length of horizontal portion 2 of the steam injector wells 3 and accordingly not serving the intended purpose of heating oil 9 in the development region 10. Substantial losses in efficiency of the SAGD process result and high SOR (Steam-Oil Recovered ratio) are accordingly caused.

Figure 3:
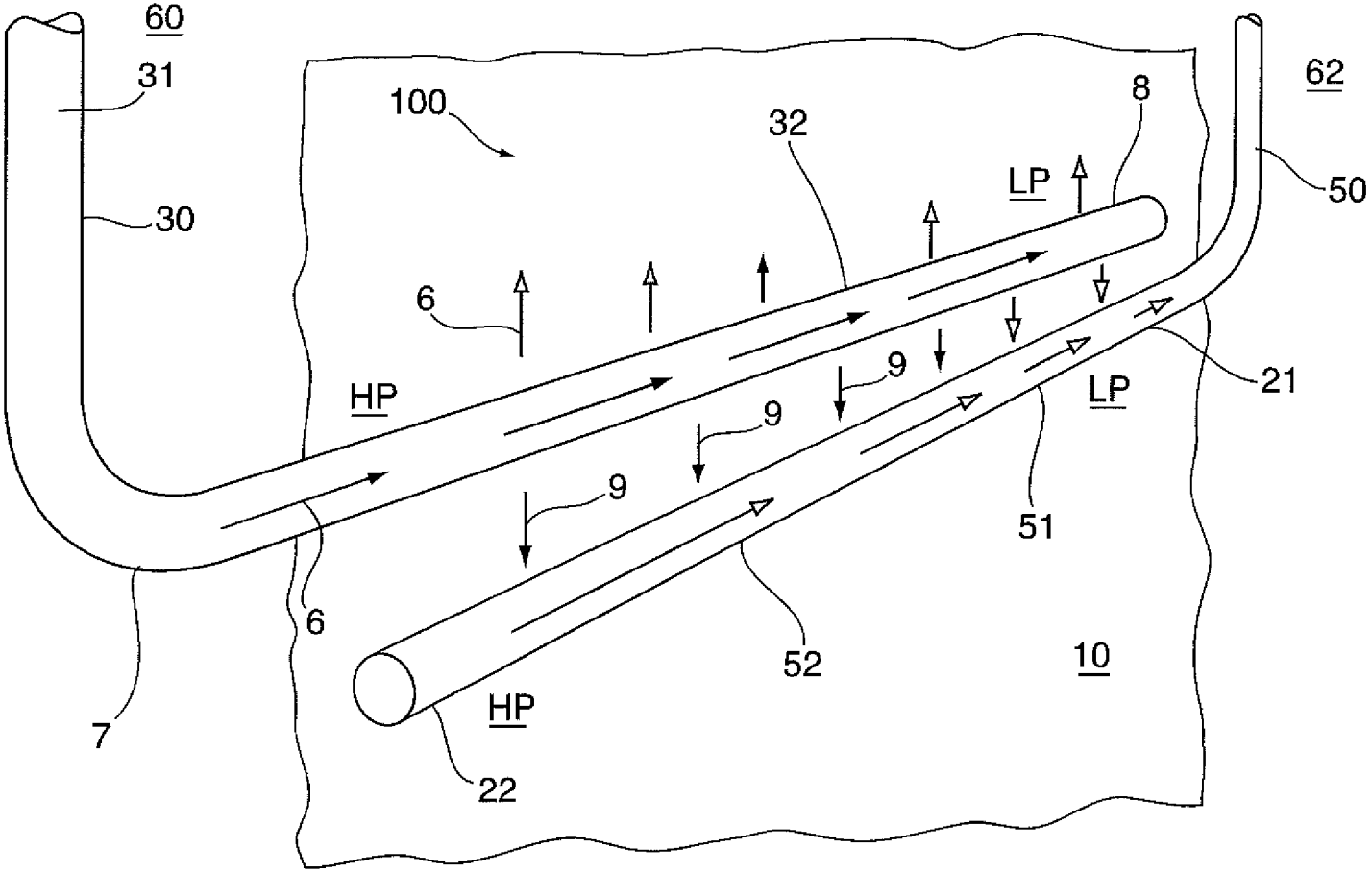
FIG. 3 is a perspective view of another embodiment of the present invention, where the injector well and collector wells are each drilled at mutually opposite ends of a development region of a formation, and the direction of flow of the injected steam is in the same direction as the direction of flow for the collected oil in the region under development.

In order to minimize the foregoing problem, FIG. 3 shows a first embodiment of the present invention, illustrating a modified SAGD configuration 100 and a modified SAGD method for recovering oil from region 10 of a formation being developed. As may be seen, an injector well 30 is drilled at one end 60 of the region 10 of the formation under development. Injector well 30 has a vertical or inclined portion 31 and a substantially horizontal portion 32.

In accordance with such first embodiment, at least one production well 51 is drilled at a mutually opposite end 62 of region 10 under development. The at least one production well 51 has an inclined or vertical shaft portion 50 and a horizontal collector portion 52 positioned substantially parallel and proximate to the horizontal portion 32 of injector well 30 but spaced vertically below said horizontal portion 31 and extending into the development region 10.

Pressurized steam 6 is injected into injector well 30 and into the development region 10 of a hydrocarbon-containing formation, via apertures (not shown) in horizontal portion 32 of injector well 30. Oil 9 which has become heated drains downwardly and flows into the horizontal collector portion 52 via apertures therein such as slotted screens or the like (not shown), and is thereafter produced to surface.

Advantageously, by drilling the at least one production well 51 at a mutually opposite end 62 of the region 10 under development than an end 60 at which said injector well 30 is drilled, steam 6 is able to be injected along horizontal collector portion 32, with the highest steam pressure HP being at heel end 7 of injector well 30 and with the lowest steam pressure LP being at the toe end 8 (due to pipe losses along horizontal portion 32 of injector well 30). Similarly with the horizontal collector portion 52, due to oil 9 being withdrawn from heel end 21 thereof, the lowest pressure LP of oil 9 in such collector portion 52 is at heel end 21, while the highest pressure HP is at toe end 22. With such configuration the pressure differential between the horizontal portion 32 of the injector well 30 and the parallel horizontal portion 52 of production well is reduced, resulting in more uniform injection of steam 6 into region 10 along a length of horizontal portion 32 of injector well 30 and the tendency for steam to directly "short circuit" from a region of high pressure to a region of low pressure in the horizontal collector portion of production well 51 is greatly reduced.

Alternative Embodiment

Figure 2A:
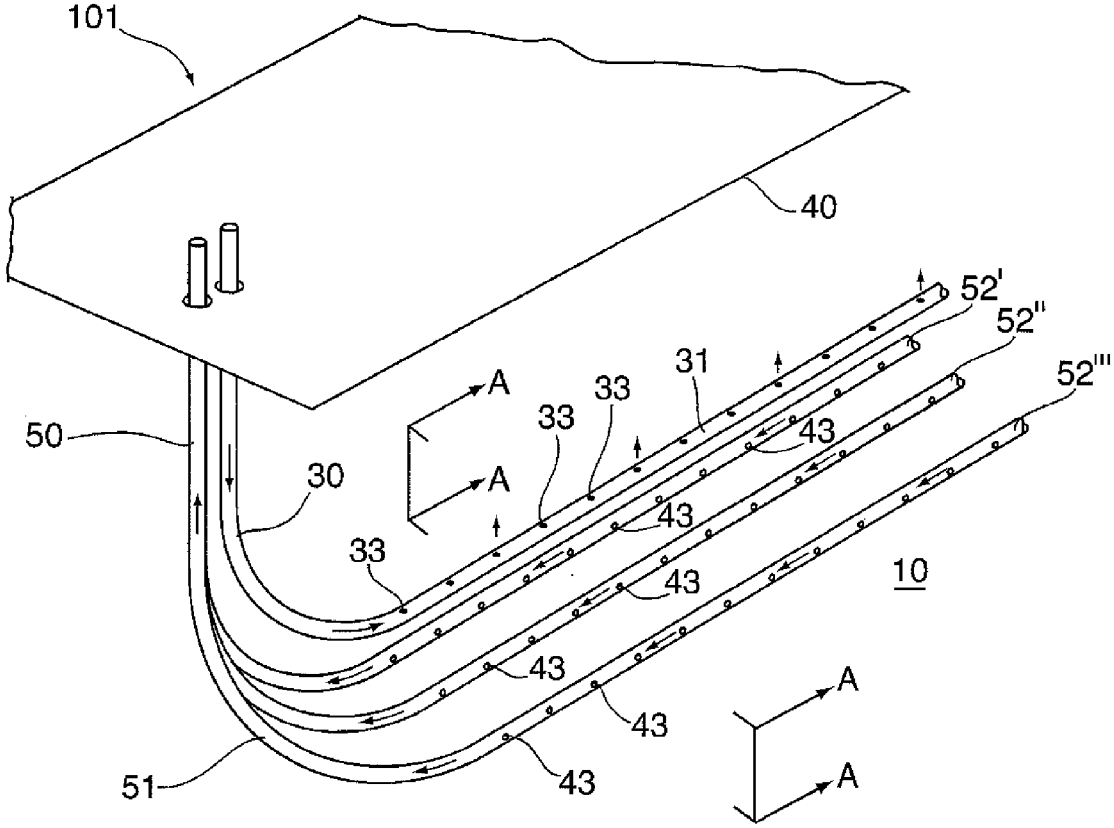
FIG. 2*a* is a perspective view of a first embodiment of the present invention, comprising a single upper injection well and multi-lateral collector wells as offshoots of a single vertical or inclined production well shaft.
Figure 2B:
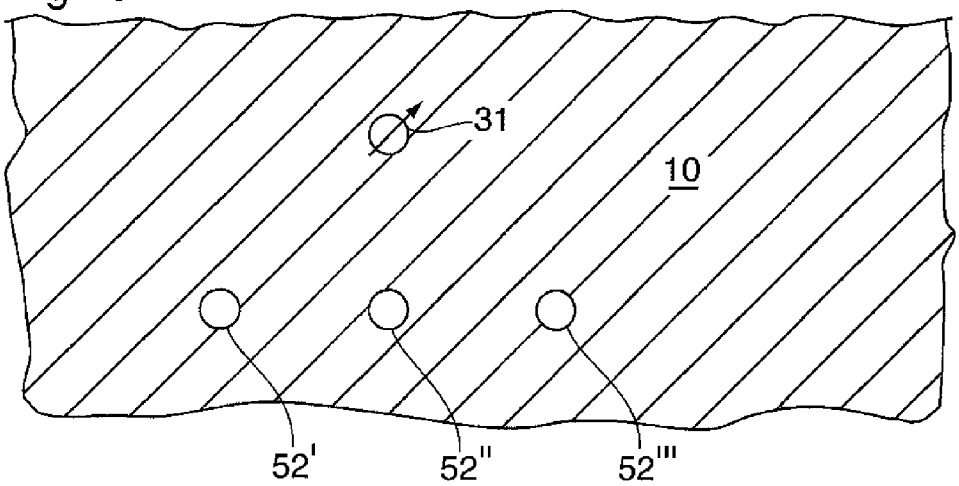
FIG. 2*b* is cross-section along plane A-A of FIG. 2*a;*

FIG. 2*a* & FIG. 2*b* illustrate an alternative embodiment 101 of the invention comprising a method of SAGD recovery wherein the number of production wells has been increased in proportion to the number of injector wells, which modification has been experimentally found for typical formation conditions and for the same total number of wells drilled as per a typical prior art SAGD well pair configuration, to increase production rates and total production (see Example 1B compared to Example 1A herein, below).

Specifically, such modification to the prior art SAGD methods comprises drilling, as per prior art SAGD methods, a single injector well 30, having a horizontal portion 31 with a series of apertures 33 therein to allow injection of steam into a region 10 in the formation under development.

Thereafter, however, rather than a single production well being drilled in relation to the single injector well 30, a plurality of substantially parallel horizontal collector wells 52', 52", and 52'" are drilled, extending parallel to the horizontal portion 31 of the injector well 30, but spaced vertically below such horizontal portion 31 of injector well 30, as best shown in FIG. 2*b*.

In a preferred embodiment, in order to reduce the capital cost of such modified SAGD configuration, the plurality of horizontal collector wells 52', 52", and 52'" wells are drilled using multi-lateral well drilling techniques in a manner so as to extend outwardly from a common vertical shaft 50 of a production well 51, as shown in FIG. 2*a*. Each of collector wells 52', 52", and 52'" have apertures 43 therein such as screened slots which resist ingress of sand but allow ingress of oil 9 into the collector wells 52', 52", and 52' for subsequent production to surface 40 via common vertical shaft portion 50. Advantageously in such manner, namely by being able to use a common vertical shaft portion 50 for each of horizontal collector wells 52', 52", and 52'", the capital cost of drilling such horizontal collector wells 52', 52", and 52'" can be reduced as compared to the cost of otherwise drilling individual separate production wells.

Multi-lateral well drilling techniques are herein defined as a well drilling technique having one main wellbore (eg vertical shaft 50 in FIG. 4*a*), with lateral wellbores (eg horizontal collector wells 52', 52", and 52'" extending outwardly therefrom. The main bore or laterals can be completed in using casing, liner, screens or open hole. Drilling of multi-lateral wells has been conducted in the past in oil and gas fields, but not been publicly used or conceived to the inventor's knowledge in any patent publication for use in a SAGD application, namely for increasing the number of collector (production) wells in proportion to the number of injector wells, nor for that matter while maintaining (as explained in Examples 1A and 1B herein) the total number of wells constant as compared to a conventional SAGD configuration.

For drilling collector wells 52', 52", and 52'", various levels are suitable and satisfactory:

LEVEL 1—Open/Unsupported Junction

LEVEL 2—Main bore Cased & Cemented Lateral Open

LEVEL 3—Main bore Cased & Cemented. Lateral Cased but not Cemented

Depending on depth and length of the horizontal portion of collector wells 52', 52", and 52'", the above "level" employed, and the number of multi-lateral collector wells, the cost savings as opposed to drilling multiple separate individual production wells will vary, but nonetheless a cost savings will be achieved in most, if not all situations.

Various known methods and apparatus for diverting a drill bit laterally within a well-bore for drilling multi-lateral wells extending outwardly therefrom are known.

For example, one such downhole tool apparatus and technique for drilling a lateral well outwardly from a vertical well is disclosed in U.S. Pat. No. 4,739,843 assigned to Amoco Corporation. Other techniques may involve inserting a whipstock.

Many other variations of such tools and techniques for drilling multi-lateral wells are of common knowledge to persons of skill in the art, and are known under various trademarks, such as SealRite™[1], Hook Hanger™[2], and QuickPack™[3]

[1] SealRite™ is an United States registered trademark of Halliburton Energy Services Inc. for Multilateral oil and gas well subsurface completion equipment, namely, latch couplings, packers, liners, nipples, and whipstocks

[2] Hook Hanger™ is an unregistered trademark of Baker Hughes Inc.

[3] QuickPack™ is an unregistered trade-mark of Weatherford Inc.

In order to drill collector wells 52', 52", and 52''' in a desired direction and location, namely below horizontal portion 31 of injector well 30 and substantially parallel to each other and to horizontal portion 31 of injector well 30 and consistently placed a substantially uniform distance apart, different guiding tools and methods are available in the prior art, and are known to persons of skill in lateral drilling of wells.

Some examples are the Halliburton Company Rotating Magnet Ranging Systems ("RMRS"), the Halliburton Company 3D Rotary Steering System ("3D-RSS"), and/or the Halliburton Company Magnetic Guidance Tool ("MGT"), with the 3D-RSS system being the more accurate and recommended of such three systems.

Combined Embodiment

Figure 4A:
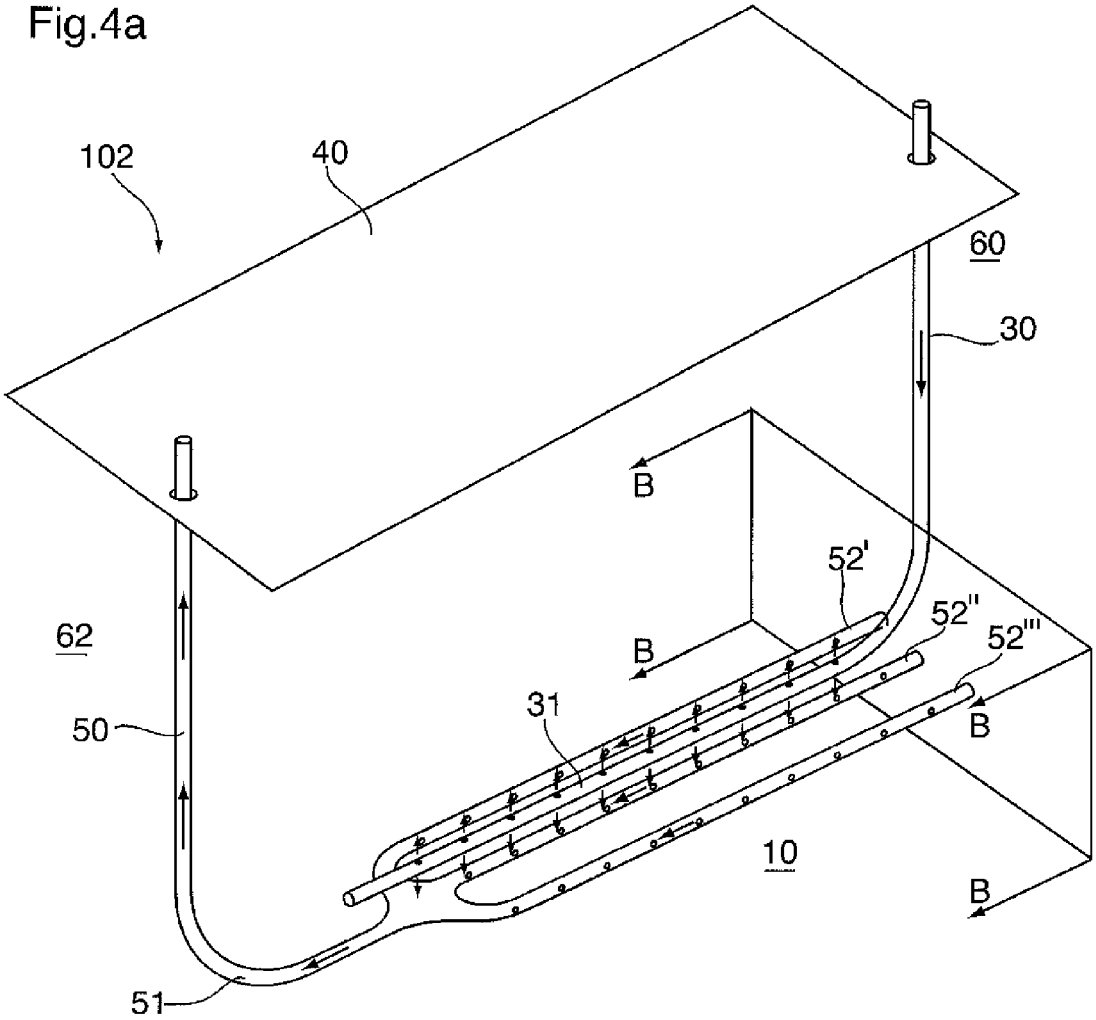
FIG. 4*a* is a perspective view of a further refinement of the present invention, comprising a plurality of multi-lateral collector wells drilled from a single vertical shaft, and a single injector well where the injector well and collector wells are each drilled at mutually opposite ends of a development region of a reservoir and the direction of flow of the injected steam is in the same direction as the direction of flow for the collected oil in the region under development.
Figure 4B:
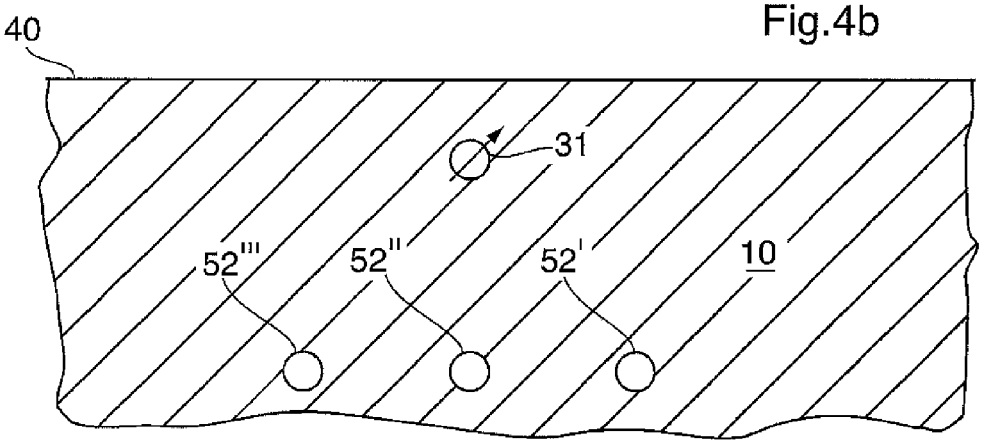
FIG. 4*b* is a cross-section along plane B-B of FIG. 4*a;*

FIG. 4A and FIG. 4*b* show a further modified SAGD configuration 102 and method of the present invention combining the advantages of the aforementioned first and alternative embodiments of the invention.

Specifically, FIG. 4A shows an embodiment of the invention 102 which combines the features and advantages of the alternative embodiment 101 shown in FIGS. 2*a* and 2*b*, namely providing a plurality of collector wells 52', 52", and 52''' in relation to each injector well 30, are combined with the modified configuration and advantages of the first embodiment shown in FIG. 3, namely having the vertical shaft 50 of the production well 51 drilled at an opposite end 62 of the region 10 under development from the end 60 of region 10 at which the injector well 30 is drilled.

Further Combined Embodiment

Figure 5A:
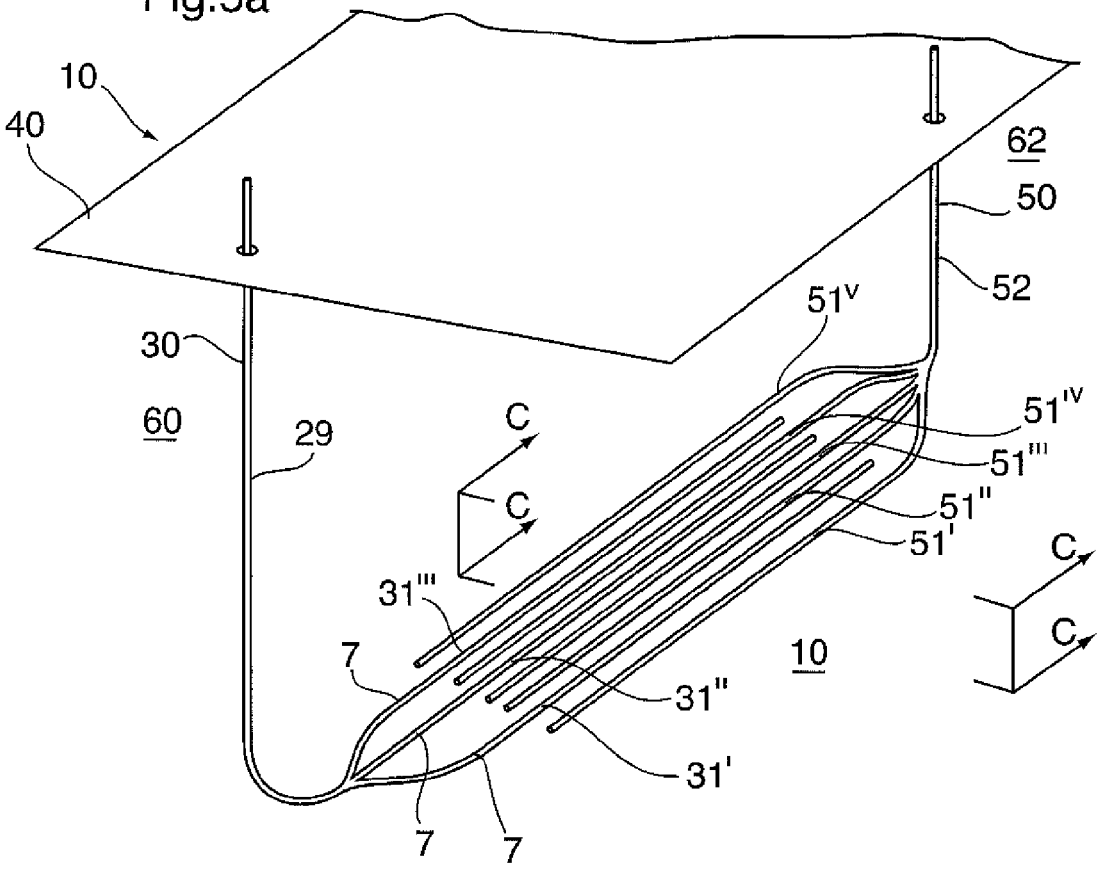
FIG. 5 *a* is a perspective view of a further embodiment of the present invention, comprising a plurality of injector wells drilled from a common vertical shaft and a similar or dissimilar plurality of collector wells likewise drilled from a common vertical shaft, wherein in such further embodiment the injector wells and collector wells are each drilled from mutually opposite ends of a development region of a reservoir and the direction of flow of the injected steam is in the same direction as the direction of flow for the collected oil in the region under development.
FIG. 5*b* is a cross-section taken along plane C-C of FIG. 5*b;*
Figure 5B:
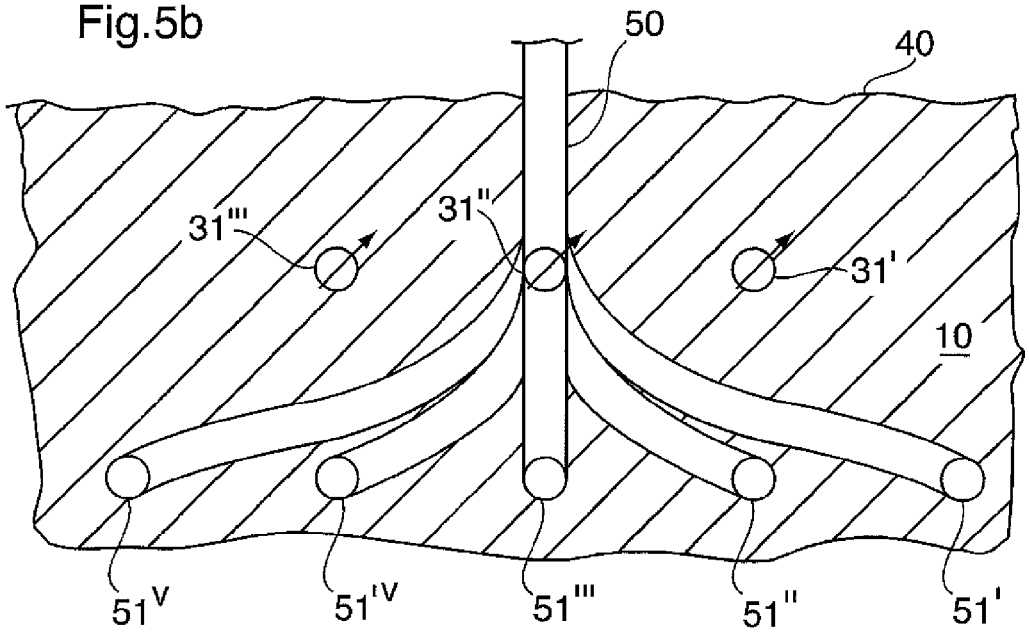

FIGS. 5*a* & FIG. 5*b* show a further modification to the embodiment 103 of the invention shown in FIG. 4*a* and FIG. 4*b*, which again takes advantage of the features of the first embodiment (production and injector wells drilled from opposite ends of a region 10), and the use of multiple collector wells in relation to injector wells, and preferably further drilling the multiple collector wells using multi-lateral techniques, with the further modification that such concept of drilling multi-lateral wells is extended to the injector wells as well.

Accordingly, in the further combined configuration and method shown in FIG. 5*a* & FIG. 5*b*, a plurality of horizontal portions 31', 31", and 31"" in the form of injector wells are drilled and paired with an equal or greater number of horizontal collector wells 51', 51", 51", 51''' and 51$^{v}$.

In such embodiment, multi-lateral collector wells 51', 51", 51''', 51$^{iv}$ and 51$^{v}$ are drilled laterally outwardly from common vertical shaft 50 using multi-lateral well drilling techniques as set out above, and similarly multi-lateral horizontal portions 31', 31", and 31''' are drilled laterally outwardly from vertical shaft 29 of injector well 30.

In a preferred embodiment, namely the embodiment shown in FIGS. 5*a* and 5*b*, the vertical shaft 50 of production well 52 is drilled at an end 62 of development region 10 opposite to an end 60 at which the vertical shaft 29 of the injector well 30 is drilled, to reduce "short-circuiting" of steam at the heel 7 of each of horizontal injector wells 31', 31", and 31''' into horizontal collector wells 51', 51", 51''', 51$^{iv}$ and 51$^{v}$.

Still Further Embodiment

Figure 10:
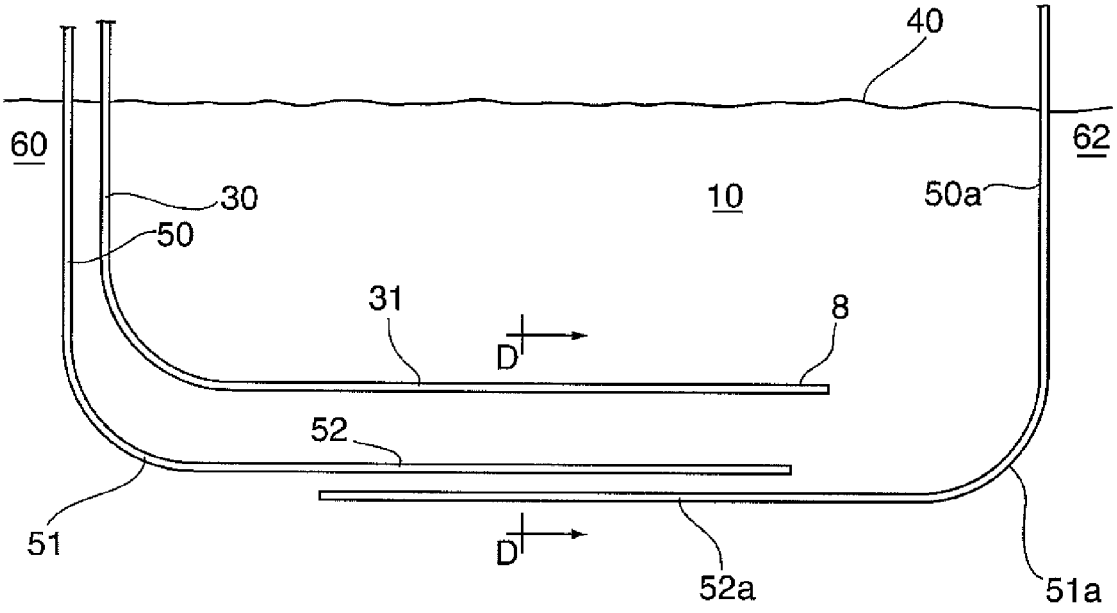
FIG. 10 is a schematic cross-sectional view of a method of the present invention for rejuvenating or restoring oil production from SAGD well pairs which have ceased to be uneconomical.
Figure 11:
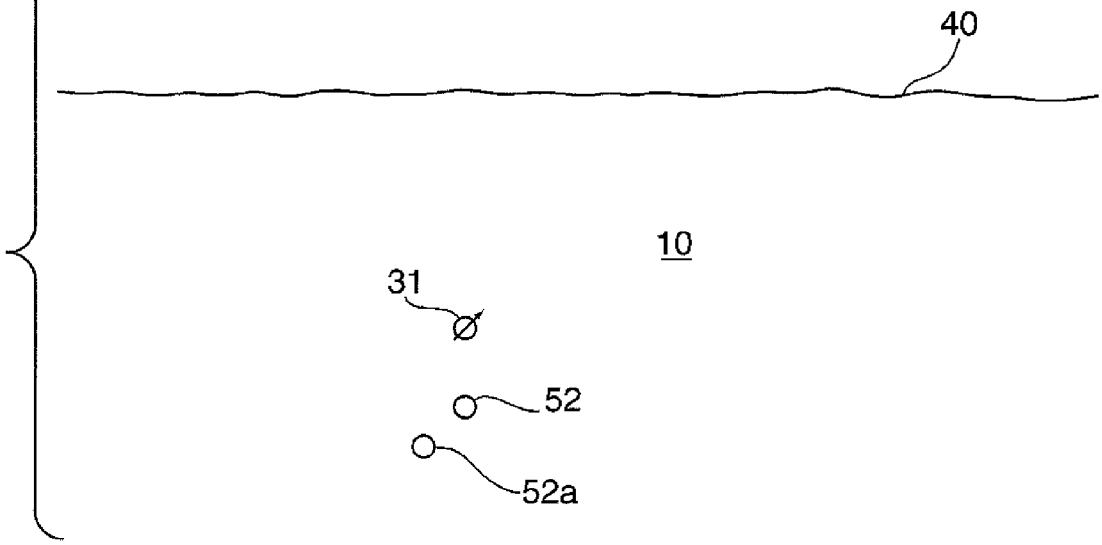
FIG. 11 is a view along plane D-D of FIG. 10.

FIGS. 10-13 broadly illustrate a further aspect of the present invention, namely methods for improving recovery from a an existing already-drilled SAGD well pair comprising a steam injector well 30 and a production well 51 combination as shown in an injector well-producer well pair 31-51 respectively in FIG. 10. Specifically, in a first embodiment of such further aspect, and as may be seen from FIG. 10, the method comprises modification to such prior art SAGD configuration by:

(i) drilling, at a second opposite end 62 of a region 10 of the formation under development proximate a toe portion 8 of the injector well 30, and via a common inclined or vertical shaft 50*a*, at least one further production well 51*a* having a horizontal portion 52*a* substantially parallel to said injector well 30 but spaced vertically below said horizontal portion 31 of said injector well 30 and extending into the development region 10 as shown in FIG. 11;

(ii) injecting steam into said injector well 30 and thereby into the region 10 of the formation under development via said horizontal portion 31 of said injector well 30; and (iii) collecting within said horizontal portion 52*a* of said at least one further production well 51*a*, heated oil 9 from said formation that has flowed into said horizontal portion 52*a* of said further production well 51*a*, and producing said oil 9 to surface.

Advantageously, by drilling new production well 51*a*, the problem of leakage of steam 9 from the injector well 30 into the heel 7 of the production well 51 is eliminated, due to the alignment of high and low pressure areas HP, LP of the injector well 30 with the corresponding high and low pressure areas HP, LP respectively of the new production well 51*a*, leading to more efficient heating of the region 10, and improved recovery.

Example 2 below provides actual test data establishing the efficacy and utility of such method in rejuvenating output from an existing SAGD well.

Figure 12:
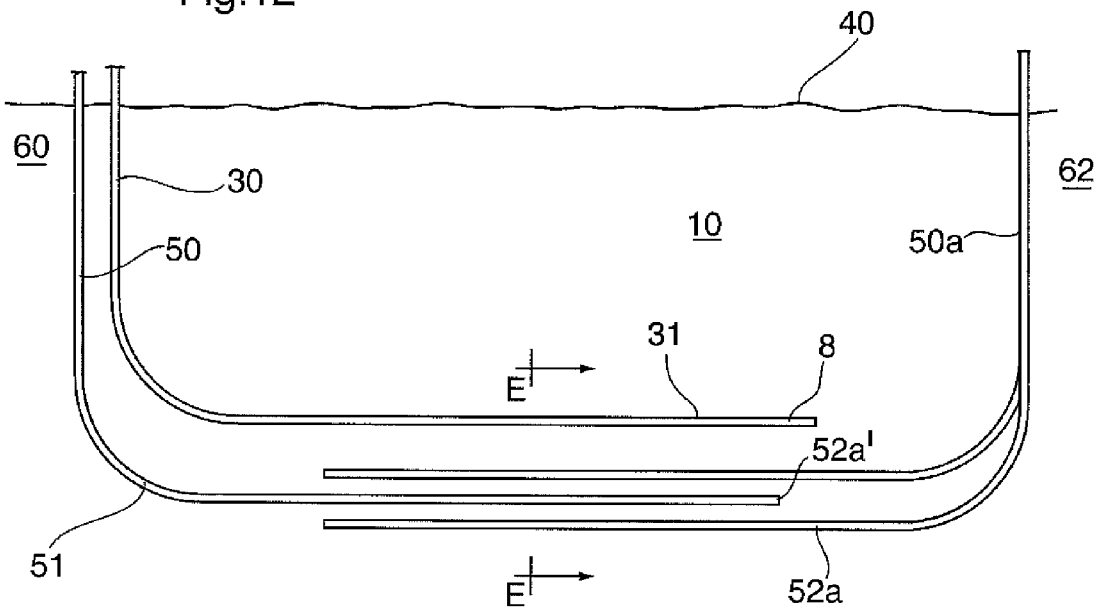
FIG. 12 is a schematic cross-sectional view of a further embodiment of a method of the present invention for rejuvenating or restoring oil production from SAGD well pairs which have ceased to be uneconomical.
Figure 13:
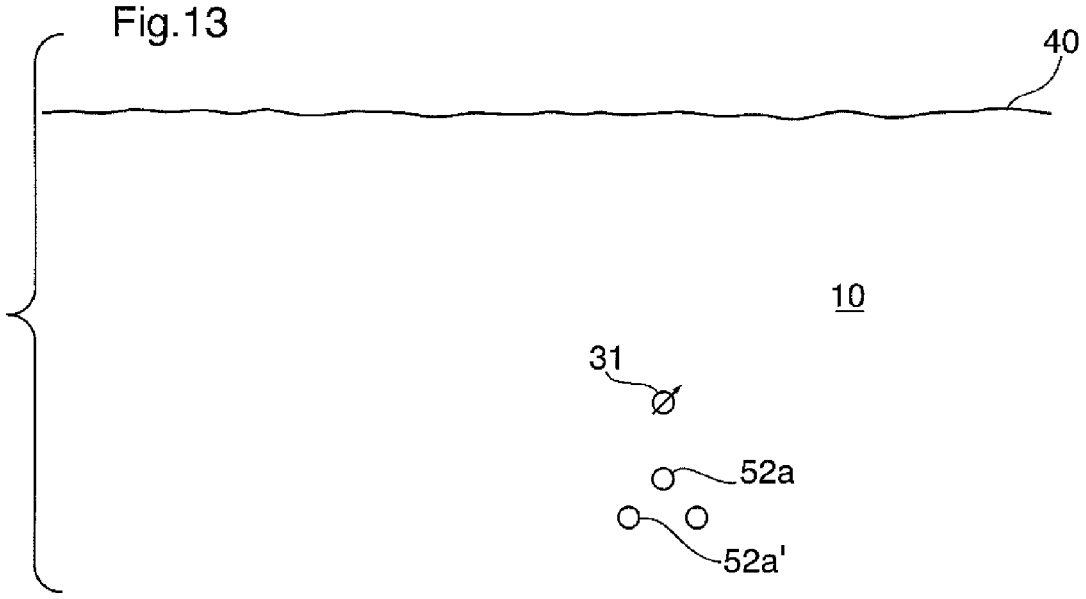
FIG. 13 is a view along plane E-E of FIG. 10.

FIGS. 12 & 13 illustrate a further refinement and modification of the above method to rejuvenate an existing SAGD well pair comprising an existing injector well 30 and an existing production well 51, both drilled from one end 60 of a region 10 of a formation under development. In such further refinement, instead of drilling a production well 51*a* at an opposite end of a formation 10 wherein such production well 51*a* possesses only one horizontal portion 52*a*, in such refined method multi-lateral well drilling techniques as discussed above are used to drill a plurality of horizontal collector wells 52*a*, 52*a*' extending outwardly from the vertical shaft portion 50*a* of production well 51*a*. In such manner, not only are the benefits of avoiding leakage achieved similar to the configuration and method depicted in FIG. 10, 11 achieved, but further benefits of total production and improved initial recovery are further achieved due to the increased ratio of collector wells 52*a*, 52*a*' to injector well 30.

Example 1A

Figure 6:
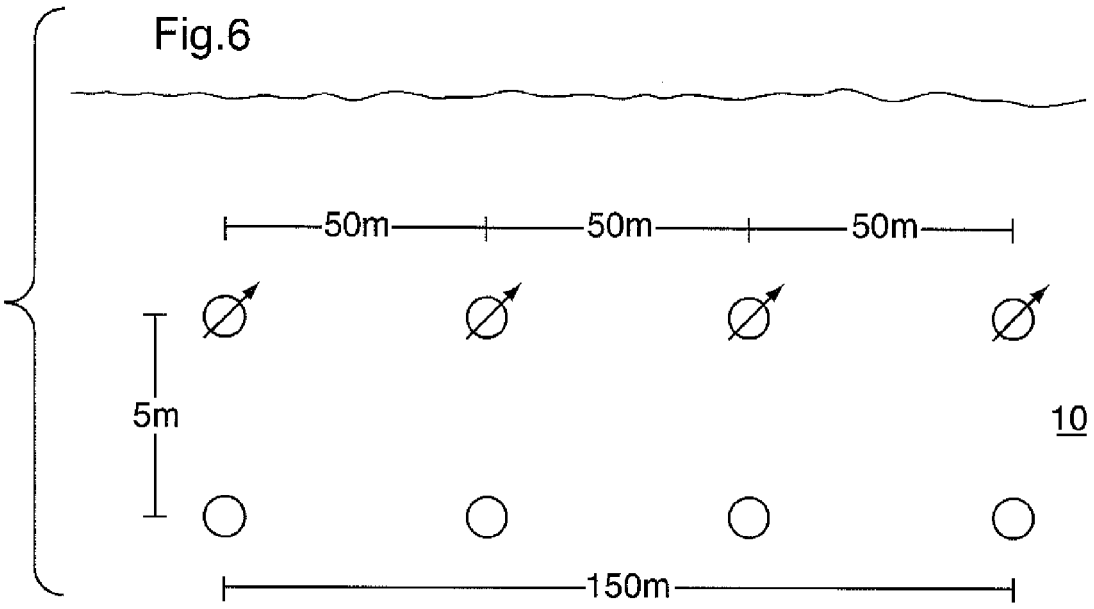
FIG. 6 is a cross-section of prior art existing SAGD well pair configuration used in computer simulation for obtaining baseline computer simulation results for comparative purposes of production rates and cumulative oil produced for such a configuration, such results shown graphically in FIGS. 8 & 9 by the line "SAGD"

In order to establish baseline production data from a prior art SAGD configuration, a traditional prior art SAGD configuration, as shown in FIG. 6 was modelled using STARS™[4] computer modelling software, version 2009.1, provided by Computer Modelling Group Limited of Calgary Alberta.

[4] Unregistered trade-mark of Computer Modelling Group Limited, of Calgary Alberta, for software programs useful for studying behavior of subterranean hydrocarbon containing formations Specifically, a hydrocarbon-containing formation having the typical properties, temperatures, porosities, permeability, and viscosity of resident bitumen therein, was assumed as shown in Table 1 below:

TABLE 1

| Properties used in the modeling | | |
|---|---|---|
| Parameter | Units | Value |
| Reservoir Propertys | | |
| Pay Thickness | m | 25 |
| True Vertical Depth (above the sub-sea elevation) | m | 134.5 |
| Porosity | % | 84 |
| Initial Oil Saturation | % | 65 |
| Initial Water Saturation | % | 15 |
| Gas Mole Fraction | fraction | 0.05 |
| Horizontal Permeability | mD | 5,000 |
| Vertical Permeability | mD | 4,000 |
| Reservoir Temperature | ° C. | 15 |
| Initial Reservoir Pressure | kPa | 3,500 |
| Rock Compressibility | 1/kPa | 7.00E−06 |
| Thermal Conductivity | J/(m.d.° C.) | 2.22E+05 |
| Well Length | m | 800 |
| Spacing of Horizontal in SAGD | m | 100 |
| Spacing of Horizontal legs Laterally (for ML-SAGD) | m | 33.33 |
| Number of Legs | | 3 |
| Rock Heat Capacity | J/(m$^3$ · ° C.) | 1.33E+06 |
| Oil Property: | | |
| Molar Density | gmole/m$^3$ | 3,419 |
| Viscosity, Dead Oil @ 18° C. | cp | 32,800 |
| Viscosity in the Steam Chamber | cP | 10 |
| Average Molecular weight Oil | AMU | 596 |
| Oil Mole Fraction | Fraction | 0.95 |
| Compressibility | 1/kPa | 5.10E−07 |
| Well control: | | |
| Steam Rate | m$^3$/d | 400 |
| Steam Quality | % | 85 |
| Producer BHP (Minimum) | kPa | 1,000 |
| Start-up duration | month | 3 |

Specifically, a series of four (4) steam injector wells 30, having horizontal portions 31, were modelled, spaced a distance of 50 meters apart.

A corresponding number of respective horizontal portions 52 of production wells 51 were modelled a uniform distance of 5 meters below, to create a series of injector-producer well pairs; each of said horizontal portions 31 and 52 being modelled of equal length (800 meters as set out in Table 1 above).

After a start-up duration of 3 months, using a steam injection rate of 400 m$^3$/day through each of the four (4) injector wells 31 (combined injection rate of 1600 m$^3$/day), the oil rate production (m$^3$/day) for such prior art SAGD well configuration was recorded over an extrapolated period extending approximately eight (8) years from May, 2012 to August 2020.

Figure 8:
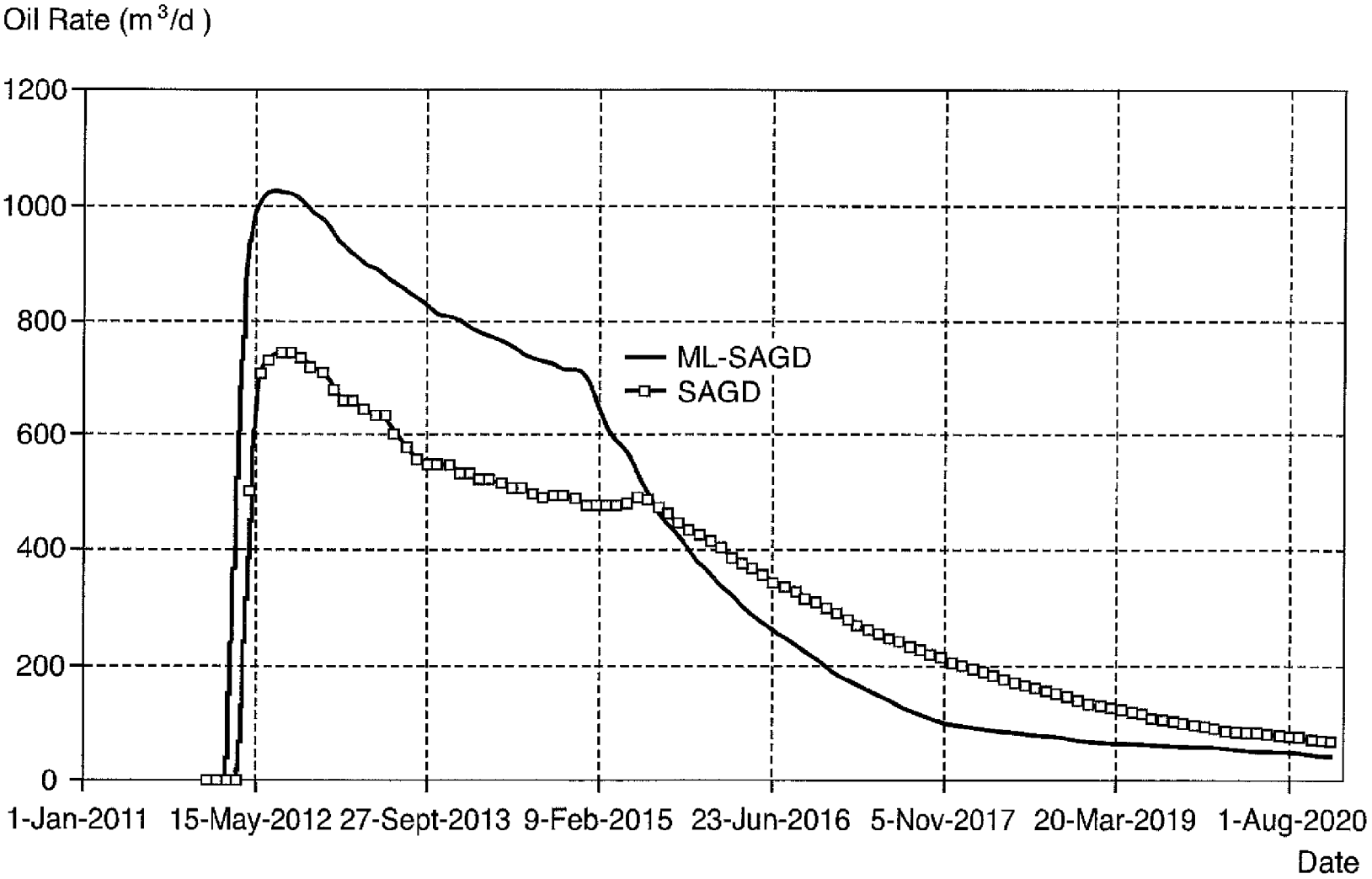
FIG. 8 is a graph of the experimentally-modelled oil production rate over time using STARS computer simulation program, extrapolated into the future, for SAGD well pairs having the configuration shown in FIG. 6 (Example 1A) & FIG. 7 (Example 1B)
Figure 9:
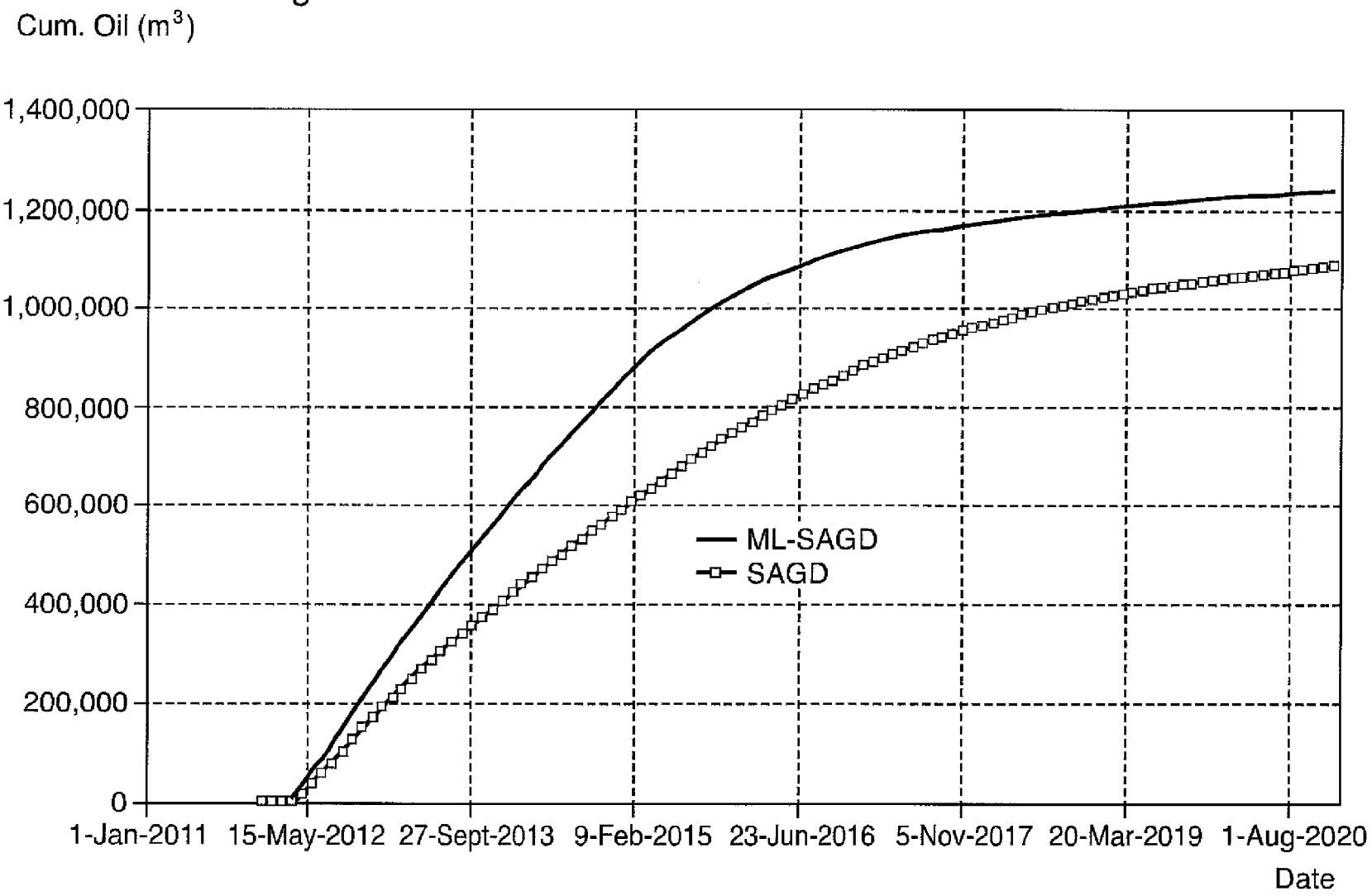
FIG. 9 is a graph of the experimentally-modelled cumulative oil produced over time, using STARS computer simulation program, for SAGD well pairs having the configuration shown in FIG. 6 (Example 1A) & FIG. 7 (Example 1B)

FIG. 8 shows a graphical representation of the obtained oil rate production (m$^3$/day) over such eight (8) year period, and FIG. 9 shows cumulative oil production over such eight (8) year period, with the appropriate line appearing as "SAGD" in both FIG. 8 & FIG. 9.

Example 1B

Figure 7:
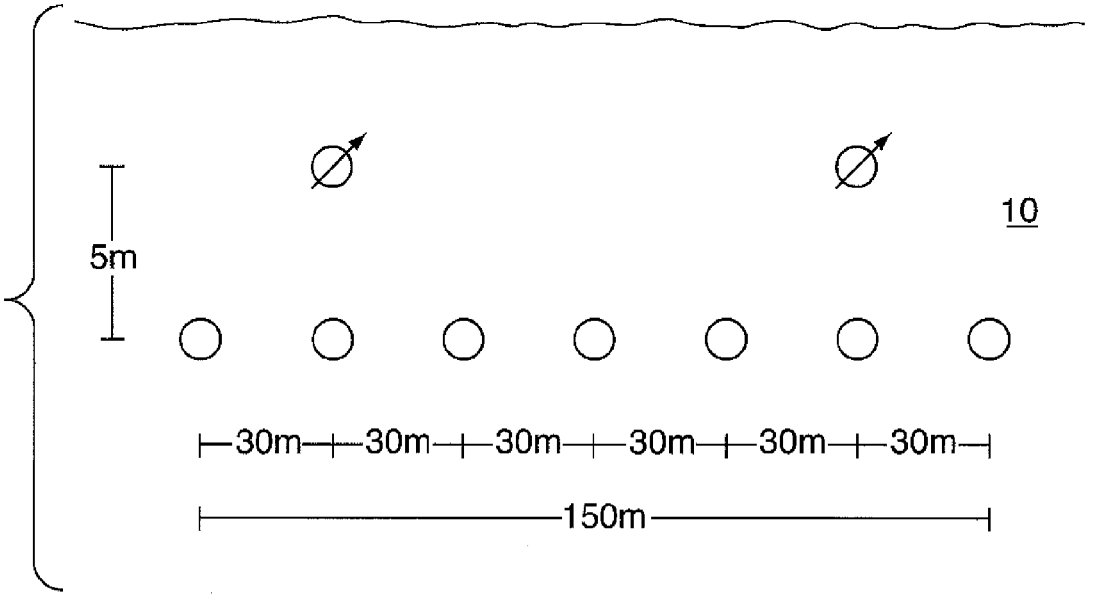
FIG. 7 is a cross-section of a modified configuration of the present invention of SAGD well pairs of lesser capital cost (where multi-lateral well drilling techniques are used for drilling the collector wells) to the configuration of FIG. 6, having multi collector wells, for purposes of comparing the production rates and cumulative oil produced for such configuration as compared to baseline results from the configuration of FIG. 6, such results obtained shown graphically in FIGS. 8 & 9 by the line "ML-SAGD"

A modified SAGD well configuration was modelled in accordance with one aspect of the invention, namely that aspect wherein the number of production (collector) wells is increased relative to the number of injector wells, and is shown in FIG. 7.

Specifically, a modified SAGD configuration was chosen, which for comparative purposes to the prior art SAGD configuration shown in FIG. 6, possessed the identical number of wells (albeit altered in ratio, namely six (6) collector wells and two (2) injector wells 30, whereas the prior art modelled configuration of FIG. 6 possessed four (4) injector wells 30 wells and four (4) production wells 51).

Identical formation properties, well length, and oil properties as used in Example 1A and as set out in Table 1 above were similarly used in this Example 1B.

Identical steam injection rates (400 m$^3$/day) were injected through the horizontal portions 31 of each of the two injector wells 30 (only 800 m$^3$/day combined steam injection steam rate), with the horizontal portions of the collector wells 52 being located a similar distance of 5 meters below the corresponding horizontal portion 31 of the injector well 30.

An identical lateral span distance of 150 meters was used, identical to the lateral span distance of 150 meters used in the standard SAGD model of FIG. 6.

After a similar start-up duration of 3 months, using a combined steam injection rate of 800 m$^3$/day through the two (2) injector wells 31, the oil rate production (m$^3$/day) for such prior art SAGD well configuration was recorded over an extrapolated period extending approximately eight (8) years from May, 2012 to August 2020.

FIG. 8 shows a graphical representation of the obtained oil rate production (m$^3$/day) over such eight (8) year period using such configuration, and FIG. 9 shows cumulative oil production over such eight (8) year period using such configuration, with the appropriate line appearing as "ML-SAGD" in both FIG. 8 & FIG. 9.

As may be seen from a comparison of lines "SAGD" and "ML-SAGD" in each of FIG. 8 & FIG. 9, for the same number of drilled wells, and the identical volume of hydrocarbon containing formation under development, the modified SAGD configuration and method of the present invention having an increased ratio of production wells to injector wells resulted in higher recovery rates and total cumulative production, and used only ½ the amount of steam injected, thereby representing a real increase in the CSOR.

Example 2

An actual SAGD well pair, existing as part of a formation under development in a Husky Energy Inc. thermal field ("the Celtic pool") that contained twenty-one (21) well pairs located near Lloydminster, Saskatchewan, was used to obtain an understanding of improvement which could be achieved by modifying an existing SAGD well pair, whose performance had diminished and become non-economical, by drilling a further production well from an opposite end of the region under development.

Details of such testing are explained in greater detail in the Canadian Society for Unconventional Gas publication SCUG/SPE SPE-149239-PP, authored by Kamran R Jorshari, and Brendan O'Hara, each of Husky Energy Inc., and presented at the Canadian Unconventional Resources Conference held in Calgary, Alberta, Canada, 15-17 Nov. 2011.

By way of summary of salient points, performance of an existing SAGD well pair in the Celtic field (Section 17, Township 52, Range 23, west of the 3rd meridian), having an injector well I4 and a production well I3, both drilled from the same end of the region under development, horizontal sections of each being separated by a distance of 4-6 meters, was monitored over time.

Average well properties of the formation in the area under development are set out in Table 2, below:

TABLE 2

| | |
|---|---|
| Formation | Sparky-GP |
| Net Pay (m) | 10~16 |
| Depth (m TVD) | 470 |
| Porosity (%) | 32 |
| Oil Saturation (%) | 80 |
| Permeability (D) | 3~5 |
| Oil Gravity (°API) | 12 |
| Initial Reservoir Pressure (kPa) | 3,300 |
| Initial Reservoir Temperature (° C.) | 16 |
| Dead Oil Viscosity @ 16° C. (mPa · s) | 33,000 |
| Oil Formation Volume Factor | 1.00 |

The I3/I4 SAGD well pair under study had been in production since Q4 of 2005, with other well pairs in the area spaced about 100 meters apart. The channel top was located at a depth of approximately 470 meters, in unconsolidated very fine to fine grain sand with little clay content. The formation sandpack had excellent porosity and permeability, and was highly saturated with heavy oil, as indicated by the 80% saturation percentage set out in Table 2 above.

The well pair in question began producing in December 2005.

Figure 14:
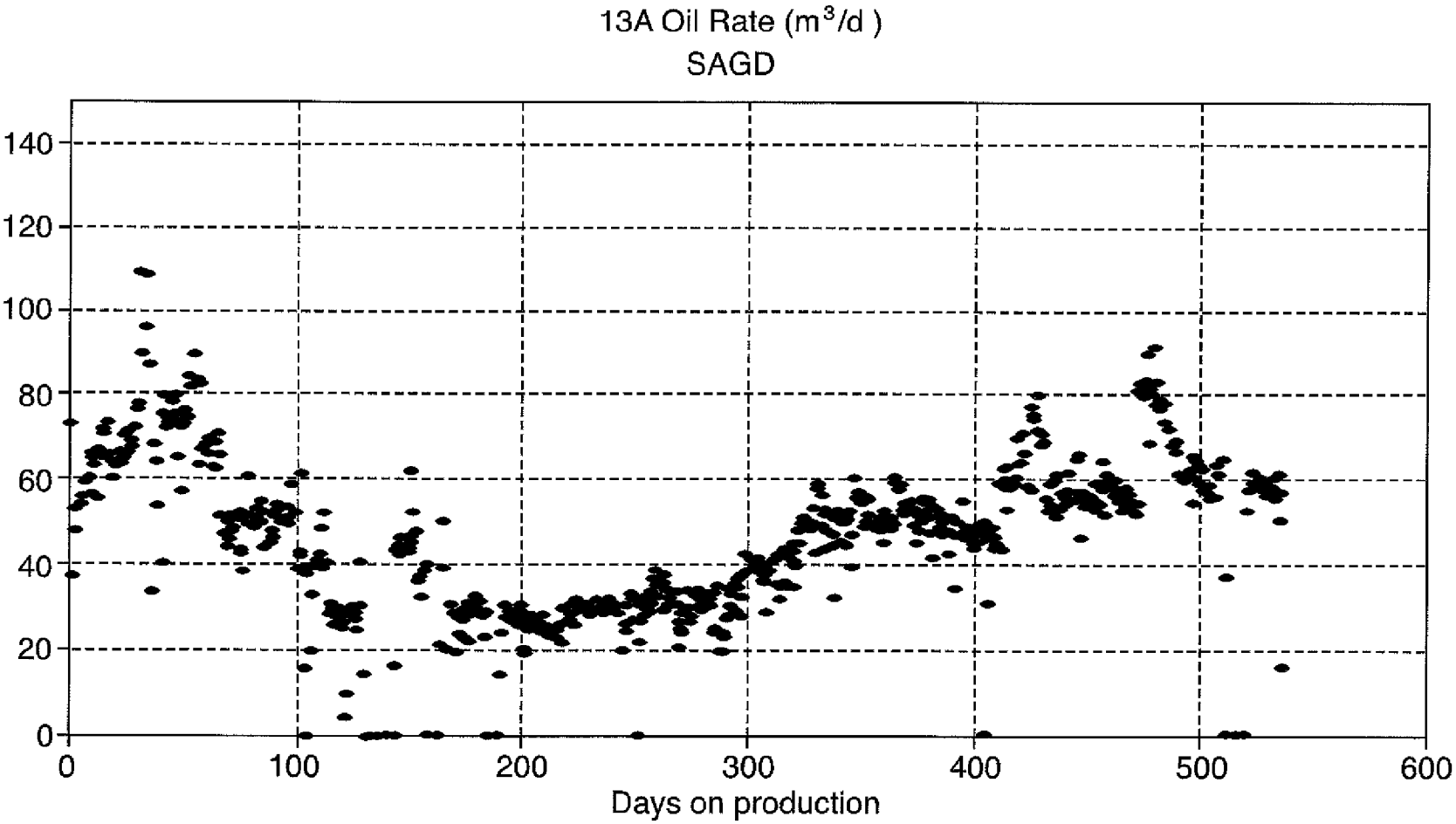
FIG. 14 is a graph of the baseline results, namely the rate of initial oil production versus time (cubic meters per day) from production well I3, for a SAGD well pair of Example 2.

FIG. 14 shows the initial oil rate for the I3/I4 well pair, from December 2005. As may be seen therefrom, oil rate never substantially exceeded 100 $m^3$/day for any extensive period of time.

Due to low production, in February 2010 a further production well I3A was drilled from the opposite end of the region under development, parallel to the existing well injector I4, but slightly below existing production well I3.

Well I3A was initially steamed for a 3 week period to maintain approximately 2,500 kPa reservoir pressure.

Thereafter, production was commenced.

Figure 15:
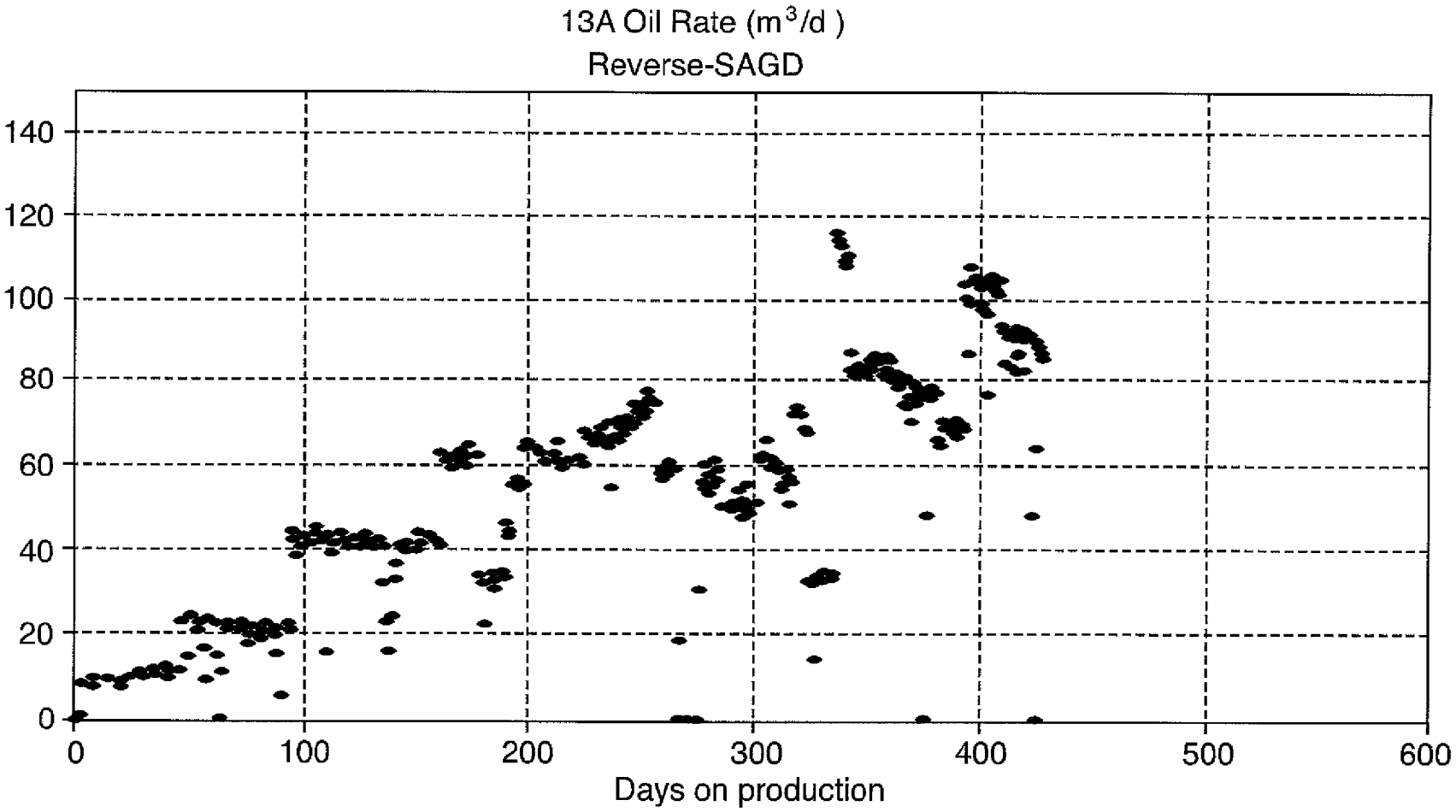
FIG. 15 is a graph of the rate of resulting oil production over time (cubic meters per day) after drilling new production well I3A, in respect of the SAGD configuration described in Example 2 having an added collector well, wherein the direction of steam flow and the direction of oil flow in the collector well is the same.
Figure 16:
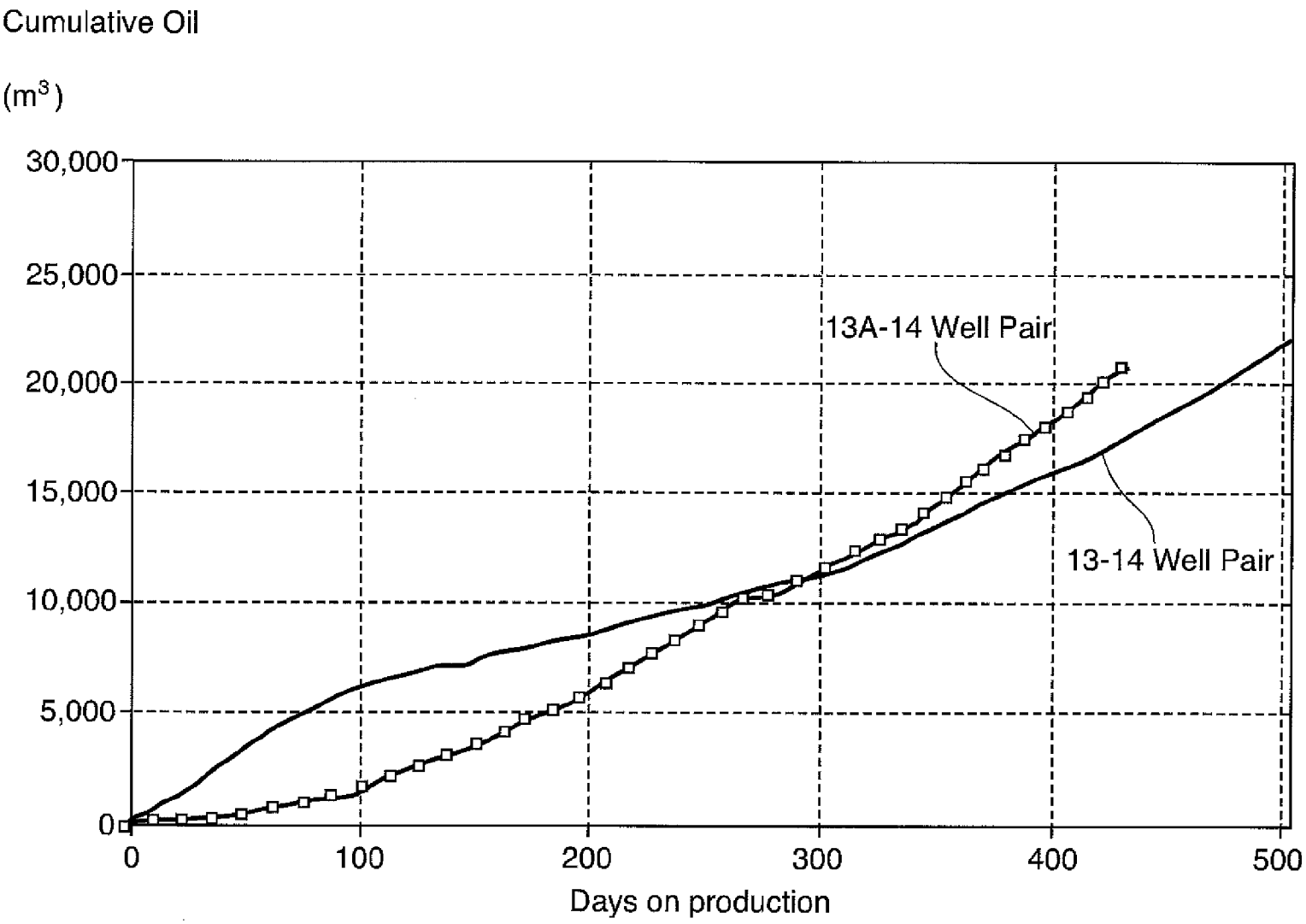
FIG. 16 is a graph of cumulative oil production (in cubic meters) as a function of time (days) comparing the I3-I4 collector-injector well pair of Example 2 with the I3A-I4 collector injector well pair of the SAGD configuration of Example 2.

FIG. 15 shows the produced oil rate over time from such modified well pair I3A/I4.

Importantly, production over time showed a linear increase, and after approximately 300 days exceeded 100 $m^3$/day, approaching 120 $m^3$/day.

The scope of the claims should not be limited by the preferred embodiments set forth in the foregoing examples, but should be given the broadest interpretation consistent with the description as a whole, and the claims are not to be limited to the preferred or exemplified embodiments of the invention.

The invention claimed is:

1. A method for recovering oil or bitumen from a development region of a hydrocarbon-containing subterranean formation utilizing a modified steam assisted gravity drainage production well, wherein the well is modified to comprise a plurality of substantially parallel horizontal collector wells, the method comprising the steps of:

(i) drilling an injection well having a vertical or inclined portion and further having a horizontal portion extending into said development region adapted for injecting a medium comprising a heated fluid or viscosity-reducing agent into said development region;

(ii) drilling a production well having a common downwardly extending inclined or vertical shaft portion and, using multi-lateral well drilling techniques, drilling said plurality of substantially parallel horizontal collector wells each extending outwardly therefrom into said development region, each of said plurality of substantially parallel horizontal collector wells extending parallel and proximate to said horizontal portion of said injection well but spaced vertically below said horizontal portion of said injection well;

(iii) injecting a medium comprising a heated fluid or viscosity-reducing agent into said injection well and thereby into the development region via said horizontal portion of said injection well to mobilize oil or bitumen; and (iv) collecting, via said plurality of substantially parallel horizontal collector wells, said mobilized oil or bitumen from said development region that has flowed into said plurality of substantially parallel horizontal collector wells; and (v) producing said mobilized oil or bitumen to surface, wherein at least two of said plurality of substantially parallel horizontal collector wells are drilled for every injection well that is drilled.

2. The method as claimed in claim 1 wherein said plurality of parallel horizontal collector wells comprises three parallel horizontal collector wells, comprising a first horizontal collector well drilled immediately below said injection well and parallel thereto, and two horizontal collector wells drilled respectively on each side of said first horizontal collector well, in mutually parallel relation, but laterally spaced therefrom.

3. The method as claimed in claim 1 or 2, wherein:

said vertical or inclined portion of said injection well is drilled at one end of said development region, and said inclined or vertical shaft of said production well is situated at a mutually opposite end of said development region, so that the medium enters said development region at one end thereof and flows in a first direction along said horizontal portion of said injection well; and said common inclined or vertical shaft of said production well is drilled at an opposite end of said development region, so that oil which collects in said horizontal collector wells flows within said horizontal collector wells in the same direction as said medium in said injection well.

4. The method as claimed in any one of claim 1 or 2, wherein said vertical or inclined portion of said injection well and said inclined or vertical shaft of said production well are one and the same.

5. The method as claimed in claim 1 or 2, wherein said medium comprises a heated fluid, and said heated fluid substantially comprises steam.

6. A method for recovering oil or bitumen from a development region of a hydrocarbon-containing subterranean formation, comprising the steps of:

(i) drilling an injection well having a vertical or inclined portion and further having a horizontal portion extending into said development region adapted for injecting a medium comprising a heated fluid or viscosity-reducing agent into said development region;

(ii) drilling a production well having a common downwardly extending inclined or vertical shaft portion and, using multi-lateral well drilling techniques, drilling a plurality of substantially parallel horizontal collector wells extending outwardly therefrom into said development region, each of said parallel horizontal collector wells extending parallel and proximate to said horizontal portion of said injection well but spaced vertically below said horizontal portion of said injection well;

(iii) injecting a medium comprising a heated fluid or viscosity-reducing agent into said injection well and thereby into the development region via said horizontal portion of said injection well; and (iv) collecting, via said plurality of parallel horizontal collector wells, oil from said development region that has flowed into said collector wells, and producing said oil to surface;

wherein said plurality of parallel horizontal collector wells comprises three parallel horizontal collector wells, comprising a first horizontal collector well drilled immediately below said injection well and parallel thereto, and two horizontal collector wells drilled respectively on each side of said first horizontal collector well, in mutually parallel relation, but laterally spaced therefrom;

wherein said medium comprises steam;

wherein the plurality of horizontal collector wells are drilled an average distance of approximately 5 meters below the associated horizontal portion injector well;

wherein the plurality of horizontal collector wells are, as between each other, separated an average distance of approximately 30 meters;

wherein the average vertical permeability of the said region under development is at least 3000 mD and the average horizontal permeability of a region under development is at least 4000 mD; and wherein the dead oil viscosity at 18° C. of the oil in the region under development is no greater than approximately 33,000 cP.

7. The method as claimed in claim 6, wherein:

the average vertical permeability of the said region under development is approximately 4000 mD and the average horizontal permeability of a region under development is approximately 5000 mD.

8. A method for improving recovery of oil or bitumen from a hydrocarbon-containing formation having an already-drilled and existing well pair by utilizing a modified steam assisted gravity drainage production well, wherein the well is modified to comprise a plurality of collector wells, the method comprising the steps of:

(i) drilling a steam injector well and a production well, said injector well having a horizontal portion extending into a region of the formation under development, said production well having vertical or inclined shaft portion and a horizontal portion substantially extending outwardly therefrom and parallel to said horizontal portion of said injector well but spaced vertically below said horizontal portion of said injector well, wherein said injector well and production well are drilled from a same first end of a region of the formation under development;

(ii) collecting oil or bitumen from the production well;

(iii) producing to surface oil or bitumen collected in step (ii);

(iv) after step (iii), drilling, using multi-lateral well drilling techniques, from said vertical or inclined shaft portion of said production well, said plurality of collector wells, extending outwardly therefrom and parallel to said horizontal portion of said injector well, said collector wells spaced vertically below said horizontal portion of said injector well;

(v) injecting a medium comprising a heated fluid such as steam or a viscosity reducing agent into the formation via said injector well; and (vi) collecting oil or bitumen which drains into said collector wells; and (vii) producing to surface oil or bitumen collected in step (vi).

* * * * *